US009004299B2

(12) United States Patent
Hardin

(10) Patent No.: US 9,004,299 B2
(45) Date of Patent: Apr. 14, 2015

(54) STORAGE RACK

(75) Inventor: William R. Hardin, Carlsbad, CA (US)

(73) Assignee: William R. Hardin, Carlsbad, CA (US)

( * ) Notice: Subject to any disclaimer, the term of this patent is extended or adjusted under 35 U.S.C. 154(b) by 361 days.

(21) Appl. No.: 13/052,966

(22) Filed: Mar. 21, 2011

(65) Prior Publication Data

US 2012/0241400 A1 Sep. 27, 2012

(51) Int. Cl.
*A47F 5/02* (2006.01)
*A47B 49/00* (2006.01)
*A47B 61/04* (2006.01)

(52) U.S. Cl.
CPC ..... *A47B 49/004* (2013.01); *A47B 61/04* (2013.01)

(58) Field of Classification Search
CPC ..... A47F 5/02; A47F 5/05; A47F 7/08; A47F 3/10; A47B 61/04; A47B 49/004; A47B 49/006; A47B 49/00; A47B 47/00; A47B 77/16; A47B 57/10; A47B 57/08
USPC ..... 211/144, 163, 129.1, 131.1, 115, 95, 211/77, 78, 37, 1.53, 58; 312/125, 135, 312/305; 108/139, 103, 22
See application file for complete search history.

(56) References Cited

U.S. PATENT DOCUMENTS

| | | | | | |
|---|---|---|---|---|---|
| 333,210 | A | * | 12/1885 | Fisher | 108/60 |
| 863,767 | A | * | 8/1907 | Weaver | 211/36 |
| 1,213,026 | A | | 1/1917 | Sande | |
| 1,649,061 | A | | 11/1927 | Ensrud | |
| 1,929,677 | A | | 10/1933 | Davis | 312/157 |
| 1,961,870 | A | | 6/1934 | Weston | 211/37 |
| 2,082,088 | A | | 6/1937 | Wilson | 211/34 |
| 2,098,828 | A | | 11/1937 | Ludwick | 211/34 |
| 2,269,878 | A | | 1/1942 | Kimball | 312/157 |
| 2,326,064 | A | | 8/1943 | Pittman | 312/183 |
| 2,629,643 | A | | 2/1953 | Davidson | 312/238 |
| 2,698,776 | A | | 1/1955 | Stoeckl | 312/238 |
| 2,845,182 | A | | 7/1958 | Atkinson | 211/37 |
| 2,941,669 | A | | 6/1960 | Palay et al. | 211/1.6 |
| 2,973,867 | A | | 3/1961 | Cohen | 211/37 |
| 3,039,599 | A | | 6/1962 | Mintz | 206/7 |
| 3,135,389 | A | | 6/1964 | Farley | 211/37 |
| 3,198,594 | A | | 8/1965 | Murray | 312/238 |
| 3,297,372 | A | * | 1/1967 | Brader | 312/45 |
| 3,331,513 | A | | 7/1967 | Cappelli | 211/34 |
| 3,478,890 | A | | 11/1969 | Allsop | 211/37 |
| 3,529,879 | A | * | 9/1970 | Priest | 312/111 |
| 3,539,052 | A | | 11/1970 | Bellock | 211/37 |
| 3,543,943 | A | * | 12/1970 | Joy et al. | 211/131.1 |
| 3,552,576 | A | | 1/1971 | Lahr | 211/36 |
| 3,563,390 | A | | 2/1971 | Kim | 211/35 |
| 3,608,739 | A | * | 9/1971 | Duboff | 211/40 |
| 3,661,435 | A | | 5/1972 | Miller | 312/321 |
| 3,788,241 | A | | 1/1974 | Ravreby | 108/6 |
| 3,807,826 | A | | 4/1974 | Peckenpaugh | 312/305 |
| 4,008,807 | A | | 2/1977 | Phillips | 211/34 |
| 4,036,367 | A | | 7/1977 | Stambaugh et al. | 211/37 |
| 4,089,322 | A | * | 5/1978 | Guibert | 126/261 |
| 4,140,223 | A | * | 2/1979 | Rau et al. | 211/78 |
| 4,187,975 | A | | 2/1980 | Shepherd | 229/15 |
| 4,219,248 | A | | 8/1980 | Goldberg | 312/324 |

(Continued)

*Primary Examiner* — Patrick Hawn
(74) *Attorney, Agent, or Firm* — Pillsbury Winthrop Shaw Pittman LLP

(57) ABSTRACT

A rotating storage rack including a base and a plurality of vertically stacked shelves allows high storage density for shoes, boots, and other footwear, as well as miscellaneous wardrobe accessories, including purses.

12 Claims, 4 Drawing Sheets

(56) References Cited

U.S. PATENT DOCUMENTS

| | | | | | |
|---|---|---|---|---|---|
| 4,249,318 | A | * | 2/1981 | Anderson et al. | 434/103 |
| 4,440,459 | A | | 4/1984 | Hallgren | 312/238 |
| 4,585,127 | A | | 4/1986 | Benedict | 211/34 |
| 4,688,681 | A | | 8/1987 | Bergeron | 211/36 |
| 4,688,686 | A | * | 8/1987 | Mitts et al. | 211/183 |
| 4,697,713 | A | | 10/1987 | Pryor | 211/189 |
| 4,796,960 | A | | 1/1989 | Candelas | 312/305 |
| 4,838,625 | A | | 6/1989 | Taylor | 312/252 |
| 4,858,772 | A | | 8/1989 | Phillipson | 211/36 |
| 4,915,238 | A | | 4/1990 | Cassel | 211/37 |
| 4,946,048 | A | | 8/1990 | Francois | 211/34 |
| D310,310 | S | | 9/1990 | Martinez | D6/457 |
| 5,024,168 | A | * | 6/1991 | Stravitz | 108/94 |
| 5,033,626 | A | | 7/1991 | Platti | 211/37 |
| 5,050,746 | A | | 9/1991 | Frankel | 211/34 |
| 5,065,871 | A | | 11/1991 | Chan | 211/37 |
| 5,076,442 | A | | 12/1991 | Hakeem | 211/34 |
| 5,103,985 | A | | 4/1992 | Davis | 211/37 |
| 5,104,208 | A | | 4/1992 | Gesing | 312/321.5 |
| 5,114,017 | A | | 5/1992 | Doyel | 211/34 |
| 5,117,989 | A | * | 6/1992 | Ross | 211/144 |
| 5,118,176 | A | | 6/1992 | Motley, Sr. | 312/305 |
| 5,127,528 | A | | 7/1992 | Cone | 211/34 |
| 5,152,592 | A | | 10/1992 | Krayer | 312/238 |
| 5,170,892 | A | | 12/1992 | Fromkin | 211/36 |
| 5,172,816 | A | | 12/1992 | Kline et al. | 211/37 |
| 5,188,240 | A | * | 2/1993 | Marino et al. | 211/40 |
| 5,423,435 | A | | 6/1995 | Pollard et al. | 211/37 |
| 5,533,799 | A | | 7/1996 | Nickolaus, Jr. | 312/249.12 |
| 5,542,758 | A | | 8/1996 | Brown | 312/249.2 |
| 5,547,085 | A | * | 8/1996 | Gaus | 211/40 |
| 5,636,751 | A | | 6/1997 | Frank | 211/36 |
| 5,695,073 | A | | 12/1997 | Klein et al. | 211/35 |
| 5,785,185 | A | | 7/1998 | Klebba | 211/37 |
| 5,813,547 | A | | 9/1998 | Rice | 211/34 |
| 5,855,279 | A | | 1/1999 | Klein et al. | 211/35 |
| 6,086,171 | A | | 7/2000 | Ashley et al. | 312/97.1 |
| 6,102,216 | A | | 8/2000 | Frank | 211/85.3 |
| 6,119,871 | A | | 9/2000 | Mengel | 211/34 |
| 6,206,493 | B1 | * | 3/2001 | Sanchez-Levin et al. | 312/125 |
| 6,439,406 | B1 | | 8/2002 | Duhon | 211/131.1 |
| 6,464,087 | B1 | | 10/2002 | Klein et al. | 211/35 |
| 6,467,613 | B2 | | 10/2002 | Felsenthal | 206/213 |
| 6,502,707 | B1 | * | 1/2003 | Sullivan | 211/163 |
| 6,581,786 | B1 | | 6/2003 | King et al. | 211/34 |
| 6,719,157 | B2 | | 4/2004 | Stoddart et al. | 211/118 |
| 8,246,127 | B1 | * | 8/2012 | Clausen | 312/292 |
| 2003/0230502 | A1 | | 12/2003 | Siegel | 206/286 |
| 2004/0035806 | A1 | | 2/2004 | Klein et al. | 211/34 |
| 2004/0104188 | A1 | * | 6/2004 | Russell et al. | 211/78 |
| 2004/0118791 | A1 | | 6/2004 | Rimback et al. | 211/34 |
| 2005/0023229 | A1 | | 2/2005 | Ashley et al. | 211/38 |
| 2007/0125733 | A1 | * | 6/2007 | Brandon | 211/163 |
| 2009/0236954 | A1 | | 9/2009 | Kobayashi et al. | 312/36 |

* cited by examiner

STORAGE RACK

FIELD OF THE INVENTION

The invention relates to storage racks, in particular for shoes.

BACKGROUND OF THE INVENTION

Typically, closets at home do not have enough storage space for purses, shoes, boots, and other footwear. Existing storage racks for shoes have a low storage density, as well as other practical limitations. Simultaneously, (walk-in) closets are typically underused, in terms of storage, in one or more corners. Accordingly, there is a need for improved storage capabilities.

SUMMARY

One aspect of the disclosure relates to a rotating storage rack having a rotational axis and a maximum rotational radius. The rotating storage rack includes a base configured to support shelves and a plurality of vertically stacked shelves supported by the base. At least one shelf includes vertical partitions radially extending outward from the rotational axis.

In certain embodiments, the rotating storage rack comprises one or more vertical sides disposed beyond the maximum rotational radius, wherein one or more vertical sides are configured to receive a hanger rail. In certain embodiments, the vertical partitions extend less than the maximum rotational radius, e.g. by leaving the center area of each shelf clear. At least two vertical partitions may include a support feature configured to support an additional shelf. At least one shelf may include a support feature configured to support an additional vertical partition. In certain embodiments, two or more vertically stacked shelves are independently rotatable.

In certain embodiments, the plurality of vertically stacked shelves is arranged to create shelves having different heights. Some embodiments including at least two vertical sides disposed beyond the maximum rotational radius comprise two vertical sides connecting at a right angle. Alternatively, and/or simultaneously, some embodiments comprises two vertical sides disposed beyond the maximum rotational radius, wherein the two vertical sides are disposed at diametrically opposing sides of the rotating storage rack.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals may designate corresponding parts in the various figures. It is to be expressly understood, however, that the drawings are for the purpose of illustration and description only and are not intended as a definition of any limits. As used in the specification and in the claims, the singular form of "a", "an", and "the" include plural referents unless the context clearly dictates otherwise.

DETAILED DESCRIPTION

Storage capacity at home for purses, shoes, boots, and other footwear may be improved by using embodiments disclosed in this specification. Practical limitations of existing storage or shoe racks may be reduced or eliminated. Additionally, the rotating storage racks contemplated herein also accommodate purses, wallets, rolled-up ties, rolled-up belts, scarves, and/or other wardrobe accessories.

Figure 1:
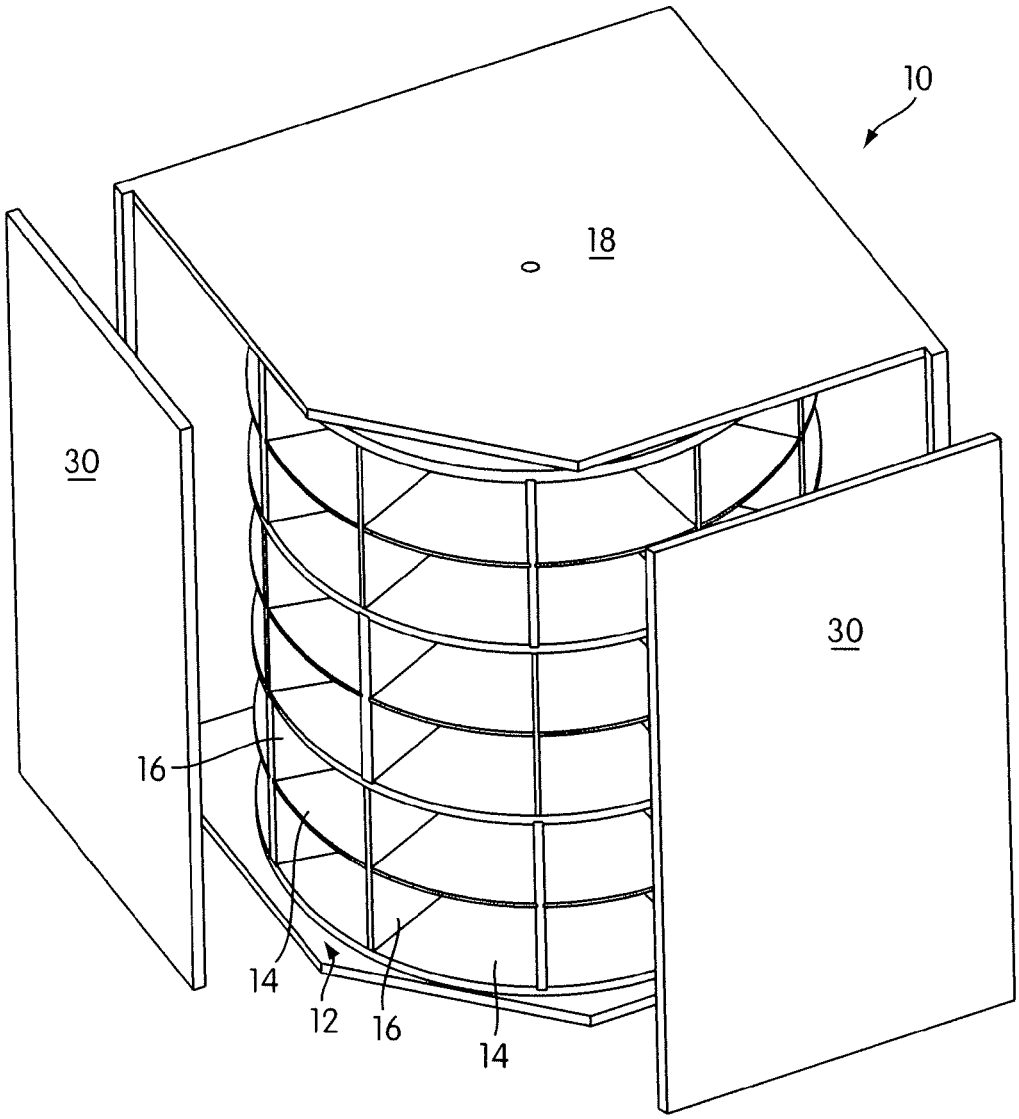
FIG. 1 schematically illustrates an exploded view of a rotating storage rack according to certain embodiments.

FIG. 1 schematically illustrates an exploded view of a rotating storage rack according to certain embodiments. The shape of rotating storage rack 10, when viewed from the top, is circular. Elliptical, polygonal, irregular, and/or other shapes are also contemplated. The maximum distance from any point along the rotational axis of a storage rack to the edge or end of any component (in the same plane as said point) included in the rotation is called the maximum rotational radius. For example, if the shape of the rotating storage rack is a square, with sides of length x, and the rotational axis goes through the center of the square, the maximum rotational radius equals $\frac{1}{2} \cdot x \cdot \sqrt{2}$. If any sides are included in the storage rack, mounting them further from the rotational axis than the maximum rotational radius allows the rotating storage rack to rotate fully. Including one or more (partial) sides reduces the amount of dust and dirt the stored items gather.

Figure 4D:
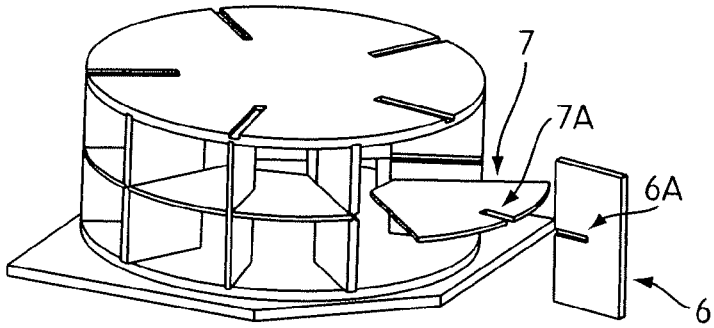
FIGS. 4A, 4B, 4C, and 4D schematically illustrate the construction of a rotating storage rack according to certain embodiments.
Figure 4C:
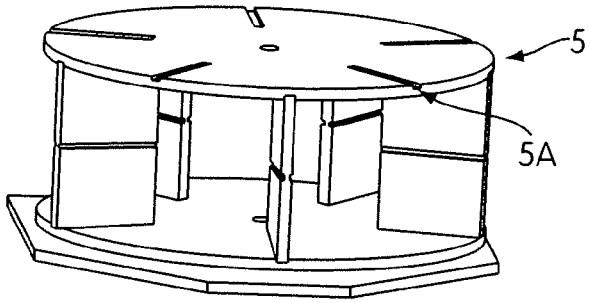
Figure 4B:
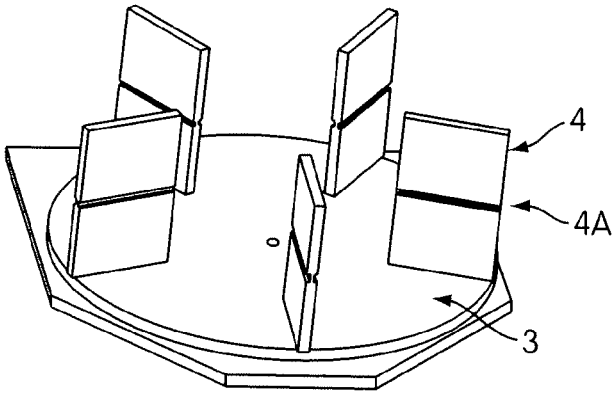
Figure 4A:
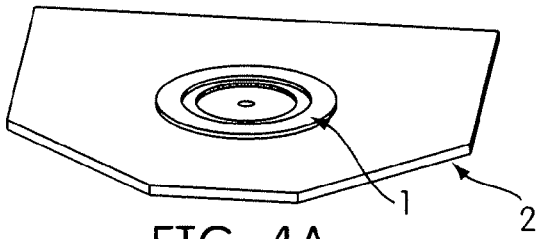

By way of illustration, FIGS. 4A-D schematically illustrate the construction of a rotating storage rack with a circular shape according to certain embodiments. Rotating bearing 1 in FIG. 4A determines the location of the rotational axis. Rotating bearing 1 is mounted to base plate 2, which forms the support for the shelves. As shown in FIG. 4B, a circular base shelf 3 may be divided into five main sections (or storage compartments) through the placement of five main vertical partitions (item 4 in FIG. 4B), each extending across an angle of 360/5=72 degrees. A practical diameter for the shelves of rotational rack 10 may be 30 inches, between 24 and 30 inches, less than 36 inches, between 65 cm and 85 cm, extending beyond the breadth of an adjacent hanger, extending beyond the shoulder-to-shoulder width of a garment hanging on a hanger, extending between 10 cm and 25 cm beyond the depth of any adjacent shelves and/or maximum breadth of any hangers, and/or other diameters. Alternatively, a shelf may be divided into four main sections, six main sections, or more than six main sections.

Referring to FIG. 1, rotating storage rack 10 comprises a base 12 configured to support shelves and a plurality of vertically stacked shelves 14 supported by base 12, wherein at least one shelf includes vertical partitions 16 radially extending outward from rotational axis 18. The height of a shelf may be more than two inches, three inches, between three and four inches, between four and five inches, less than six inches, between 15 cm and 25 cm, less than 10 cm, tall enough to hold men's and/or women's boots and other footwear up to size 12, and/or other heights. The depth of a shelf, i.e. the distance from the rotational axis to the edge of a shelf, may be 1 foot, between 1 and 3 feet, between 40 cm and 70 cm, large enough to hold men's and/or women's boots and other footwear up to size 12, and/or other depths. By way of illustration, FIG. 4C illustrates how base shelf 3 and main vertical partitions (item 4 in FIG. 4B) support shelf 5. Similarly, the vertical partitions on one shelf support the shelf mounted on top of said vertical partitions. Alternatively, shelves may be supported by a rail or post coinciding with or acting as the vertical axis. In certain embodiments, the shelves may be supported by suspending them from a top plate, which is in turn supported by vertical sides and/or suspended from a ceiling. The vertical partitions would then prevent two shelves from collapsing onto each other.

Figure 2:
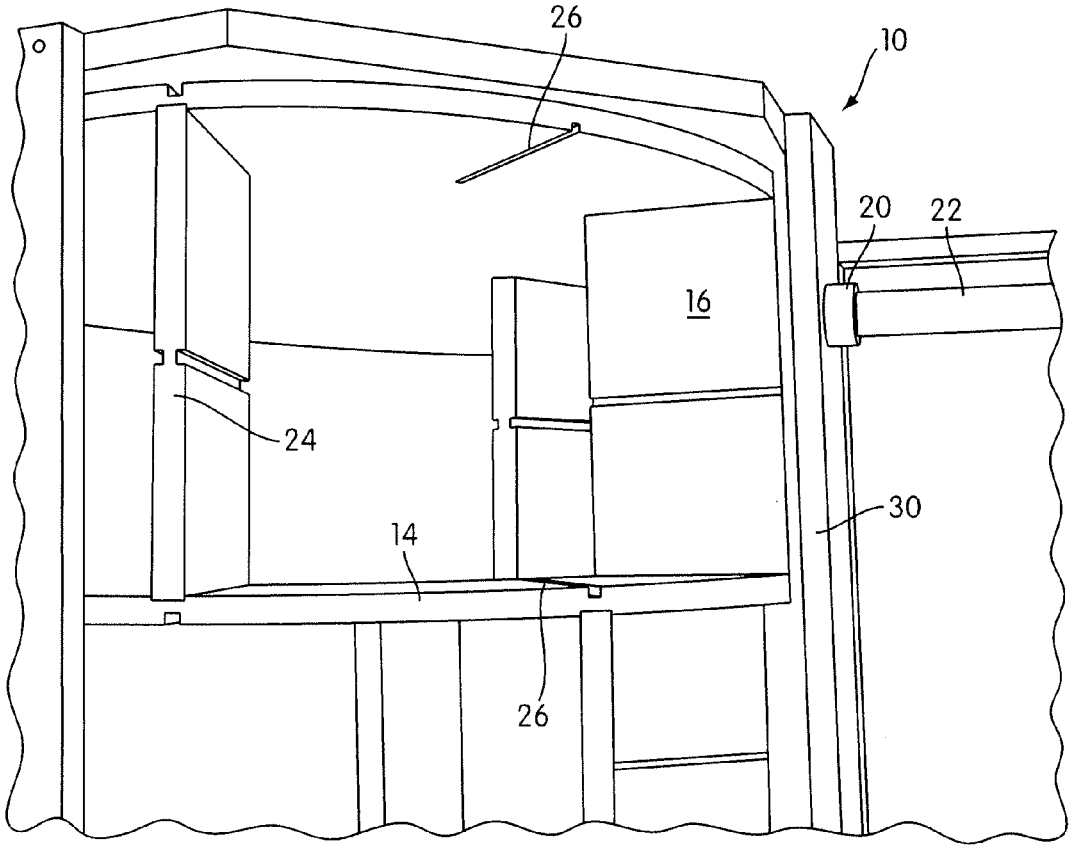
FIG. 2 illustrates a partial view of a top portion of a rotating storage rack according to certain embodiments.

FIG. 2 illustrates a partial view of a top portion of a rotating storage rack according to certain embodiments. Rotating storage rack 10 may comprise one or more vertical sides 30 disposed beyond the maximum rotational radius, wherein the vertical side may be configured to receive a hanger rail 22. Typically hanger rails have a circular cross-section with a one-inch diameter, though other shapes and sizes may be supported. A bracket 20, slot, or other mounting feature (or features) may be combined with one or more of the vertical sides 30 of rotating storage rack 10 to provide the function of receiving a hanger rail. In certain embodiments, the height of rotating storage rack 10 is less than the height of one or more mounted hanger rails, thus allowing rotating storage rack 10 to be placed under the hanger rail(s). To prevent hangers, with their respective garments, from interfering with rotating storage rack 10, either a vertical side 30, a restraining device mounted on the hanger rail, or both can be used.

Referring to FIG. 2, vertical partitions 16 may extend less than the maximum rational radius, e.g. by clearing a predetermined distance immediately surrounding the rotational axis. This cleared area may be shared among multiple sections or compartments for improved practical functionality and storage density. The predetermined distance may be less than one inch, between one and three inches, less than six inches, less than 10 cm, between 10 and 30 cm, and/or other distances. By clearing this distance, oversized, irregular, and/or oddly-shaped items may still be stored in rotating storage rack 10. By way of illustration, FIG. 4B illustrates main vertical partitions (item 4) that do not extend all the way to the rotational axis, thus leaving the center area of the rotation storage rack open. Such a shared center area may provide higher storage density, storage for oversized, irregular, and/or odd-shaped items, and/or other practical improvements. Alternatively, and/or simultaneously, distances that do not immediately surround the rotational axis may be cleared by vertical partitions 16 extending less than the maximum rotational radius.

Referring to FIG. 2, vertical partitions 16 may include a support feature configured to support an additional shelf, such as notch 24, a slot, a peg, and/or other support features. Shelves 14 may include a support feature configured to support an additional vertical partition, such as groove 26, a slot, a peg, and/or other support features. Notch 24 may divide the height of its corresponding shelf in two equal parts, in unequal parts, or in more than two parts. Groove 26 may or may not be aligned with existing vertical partitions (on the same shelf and/or on a different shelf). By way of illustration, FIG. 4D illustrates how the construction or placement of additional shelf segment 7 between base shelf 3 (see FIG. 4B) and shelf 5 (see FIG. 4C) may be combined with the placement of additional vertical partition 6 (by matching slot 6A with slot 7A, and optionally additional vertical partition 6 with slot 5A, assuming slot 5A is disposed on both sides of shelf 5). Additional shelf segments and additional vertical partitions may be user-configurable, i.e. after construction of rotating storage rack 10. As shown in FIG. 2, rotating storage rack 10 may comprise storage sections extending across an angle of 360/10=36 degrees.

Adjacent shelves of rotating storage rack 10 may be independently rotatable. Shelves 14 may have the same height or different heights.

Figure 3:
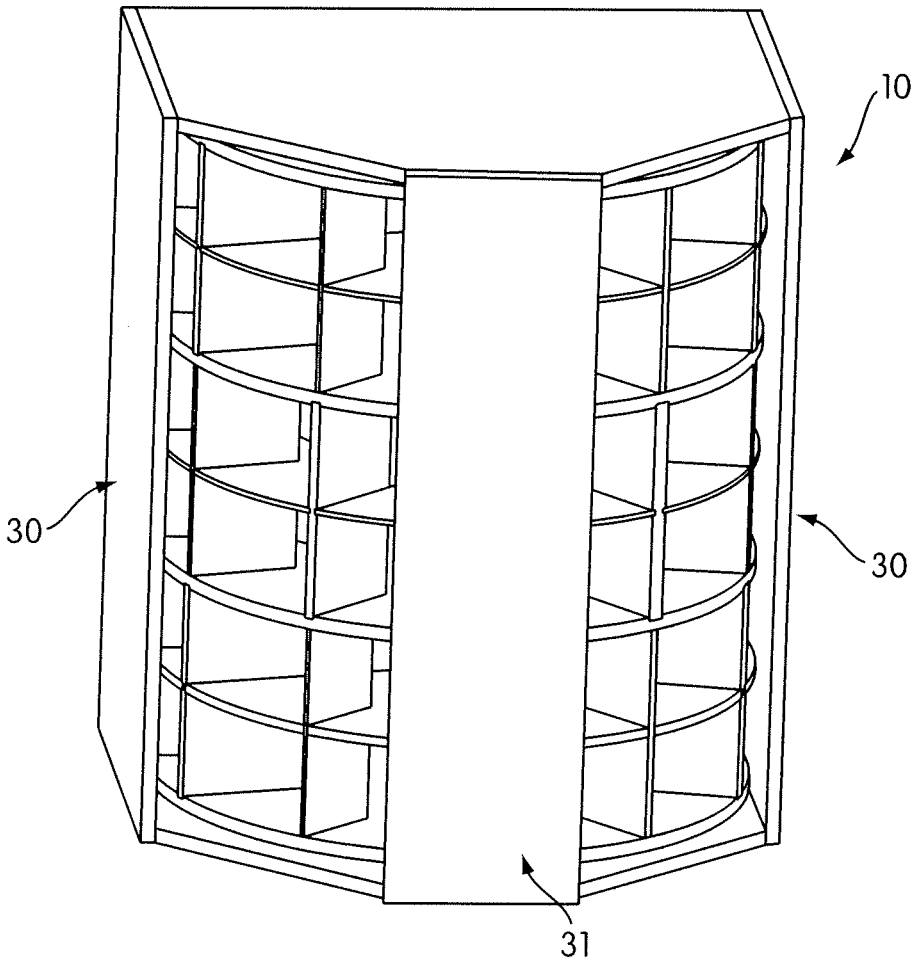
FIG. 3 schematically illustrates a rotating storage rack according to certain embodiments.

If two of the vertical sides 30 connect at a right angle, rotating storage rack 10 may be suitable to be placed in a corner of a closet. Typically the corners of (walk-in) closets have low utility as storage space, especially if hanger rails having perpendicular angles intersect in that corner. Rotating storage rack 10 provides improved storage density. Alternatively, and/or simultaneously, rotating storage rack 10 may be placed along a side or wall of a closet rather than in a corner. By way of illustration, FIG. 3 schematically illustrates a rotating storage rack according to certain embodiments. Vertical sides 30 may be configured to receive hanger rails along a side or wall of a closet. Vertical side 31, if included, may also be configured to receive a hanger rail (e.g. perpendicular to the direction of the hanger rails received by vertical sides 30), such that the rotating storage rack in FIG. 3 may connect up to three hanger rails. Note that the shape of the base (or the base plate) may be different depending on whether the rotating storage rack is to be placed in a corner or not. Rotating storage rack 10 may allow mounting features to receive hanger rails at multiple heights.

In certain embodiments, constituent components of rotating storage rack 10 are made of transparent or translucent material. Rotating storage rack 10 may include a lighting unit configured to illuminate rotating storage rack 10 and/or items stored therein. For example, a lighting unit may be disposed along or on the rotational axis of rotating storage rack 10.

Although the embodiments have been described in detail for the purpose of illustration based on what is currently considered the most practical and preferred implementations, it is to be understood that such detail is solely for that purpose and that the disclosure is not limited to certain embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. A rotating storage rack having a rotational axis and a maximum rotational radius, the rotating storage rack comprising:

a base configured to support shelves, wherein the shelves have edges at or near the periphery of the rotating storage rack; and a plurality of vertically stacked shelves supported by the base, wherein at least one shelf includes vertical partitions, wherein the at least one shelf has a center, wherein the rotational axis of the rotating storage rack intersects the at least one shelf in the center, wherein adjacent vertical partitions form storage compartments, wherein the vertical partitions form a shared shelf area around the rotational axis, wherein individual ones of the vertical partitions include distal ends and proximal ends, wherein the distal ends form distal openings at or near one or more edges of the at least one shelf, wherein the proximal ends form proximal openings facing the rotational axis, wherein the vertical partitions extend radially such that the proximal ends of the vertical partitions do not extend to the rotational axis, thereby creating, on the at least one shelf, the shared shelf area around the rotational axis so as to provide an uninterrupted surface of the at least one shelf, wherein the uninterrupted surface extends between the proximal ends of the vertical partitions, wherein the rotational axis intersects the uninterrupted surface, wherein the shared shelf area is manually accessible by a user through at least two of the storage compartments, wherein at least two vertical partitions form a storage compartment between a lower shelf and a higher shelf from the plurality of vertically stacked shelves, wherein the lower shelf is positioned below the higher shelf, wherein the at least two vertical partitions include a support feature supporting an additional shelf between the lower shelf and the higher shelf, thereby dividing the storage compartment into two storage compartments.

2. The rotating storage rack of claim 1, further comprising a vertical side disposed beyond the maximum rotational radius, wherein the vertical side is configured to receive a hanger rail.

3. The rotating storage rack of claim 1, wherein the shared shelf area is manually accessible by the user through all storage compartments formed by vertical partitions supported by a particular shelf from the plurality of vertically stacked shelves, wherein the particular shelf is the same shelf that includes the shared shelf area.

4. The rotating storage rack of claim 1, wherein at least one shelf includes a support feature configured to support an additional vertical partition.

5. The rotating storage rack of claim 1, wherein two vertically stacked shelves from the plurality of vertically stacked shelves include a lower shelf and a higher shelf, wherein the lower shelf is positioned below the higher shelf, and wherein lower shelf and the higher shelf are independently rotatable.

6. The rotating storage rack of claim 1, wherein the plurality of vertically stacked shelves is arranged to create shelves of different heights.

7. The rotating storage rack of claim 1, further comprising two vertical sides disposed beyond the maximum rotational radius, wherein the two vertical sides connect at a right angle.

8. The rotating storage rack of claim 1, further comprising two vertical sides disposed beyond the maximum rotational radius, wherein the two vertical sides are disposed at diametrically opposing sides of the rotating storage rack.

9. The rotating storage rack of claim 1, wherein the vertical partitions form the shared shelf area by leaving clear a predetermined distance of the at least one shelf that immediately surrounds the rotational axis, wherein the predetermined distance is at least two inches.

10. A rotating storage rack having a rotational axis, the rotating storage rack comprising:

a base configured to support shelves;

a plurality of vertically stacked shelves supported by the base, wherein the plurality of vertically stacked shelves includes a first shelf and a second shelf, wherein the first shelf is positioned below the second shelf, wherein the first shelf has a first center, wherein the second shelf has a second center, wherein the rotational axis of the rotating storage rack intersects the first shelf in the first center and further intersects the second shelf in the second center; and a plurality of vertical partitions arranged between the first shelf and the second shelf, wherein the plurality of vertical partitions extend radially outward from the rotational axis, wherein the plurality of vertical partitions are arranged at least a predetermined distance from the rotational axis such that the first shelf includes a shared shelf area around the rotational axis that provides a shelf surface spanning at least the predetermined distance from the rotational axis, wherein the shelf surface at the rotational axis is available for storage, wherein the rotational axis intersects the shelf surface, wherein adjacent vertical partitions form storage compartments between the first shelf and the second shelf, and wherein the shared shelf area is manually accessible by a user through all of the formed storage compartments, wherein a storage compartment formed by two adjacent vertical partitions includes user-configurable support features supporting an interlocking shelf element and an interlocking vertical element, wherein the interlocking shelf element interlocks with the interlocking vertical element to provide an additional shelf within the storage compartment and an additional vertical partition within the storage compartment.

11. The rotating storage rack of claim 10, wherein the first shelf is positioned between three and six inches below the second shelf.

12. The rotating storage rack of claim 10, wherein the vertically stacked shelves have a diameter between 20 and 36 inches.

* * * * *